124-3
4/1/86 XR 4,579,340 SR

United States Patent [19]

Jenkins et al.

[11] Patent Number: 4,579,340

[45] Date of Patent: Apr. 1, 1986

[54] BASKETBALL RETURN DEVICE

[76] Inventors: Craig D. Jenkins; Scott E. Jenkins, both of 658 S. Reed Ct., Apt. NH #12, Lakewood, Colo. 80226; Jerold D. Jenkins, 2950 Montibello Dr., Colorado Springs, all of Colo. 80918

[21] Appl. No.: 679,049

[22] Filed: Dec. 6, 1984

[51] Int. Cl.[4] ..... A63B 69/00

[52] U.S. Cl. ..... 273/1.5 A; 124/3; 124/54; 273/395

[58] Field of Search ..... 273/1.5 R, 1.5 A, 395, 273/29 A, 30, 127 C; 124/3, 54

[56] References Cited

U.S. PATENT DOCUMENTS

| | | | |
|---|---|---|---|
| 1,343,127 | 6/1920 | Hallinan | 124/54 |
| 2,199,009 | 4/1940 | Perryman | 124/3 X |
| 3,043,592 | 7/1962 | Lohr | 273/395 X |
| 3,776,550 | 12/1973 | McNabb | 273/1.5 A |

FOREIGN PATENT DOCUMENTS

| | | | |
|---|---|---|---|
| 46639 | 4/1979 | Japan | 273/29 A |

*Primary Examiner*—Paul E. Shapiro
*Attorney, Agent, or Firm*—Harvey B. Jacobson

[57] ABSTRACT

A basketball return device comprises a portable unit for positioning on a basketball court in a location generally underneath a basket into which shooting practice is to be conducted. The device includes a base with a ball-return mechanism therein and a vertically extending chute projecting upwardly from the base and terminating in a hoop-like top opening for positioning substantially directly beneath the basket. The ball-return mechanism includes a horizontal ball-collection and dispersion tube mounted in the base for swinging movement about a vertical axis so that the tube may be positioned to direct balls through an open end thereof to a required location on the court. The ball-return mechanism includes a solenoid operated plunger carried at the back of the tube for projecting balls therethrough and the device may include various electrical controls for automatically and semi-automatically operating the ball-return mechanism.

7 Claims, 3 Drawing Figures

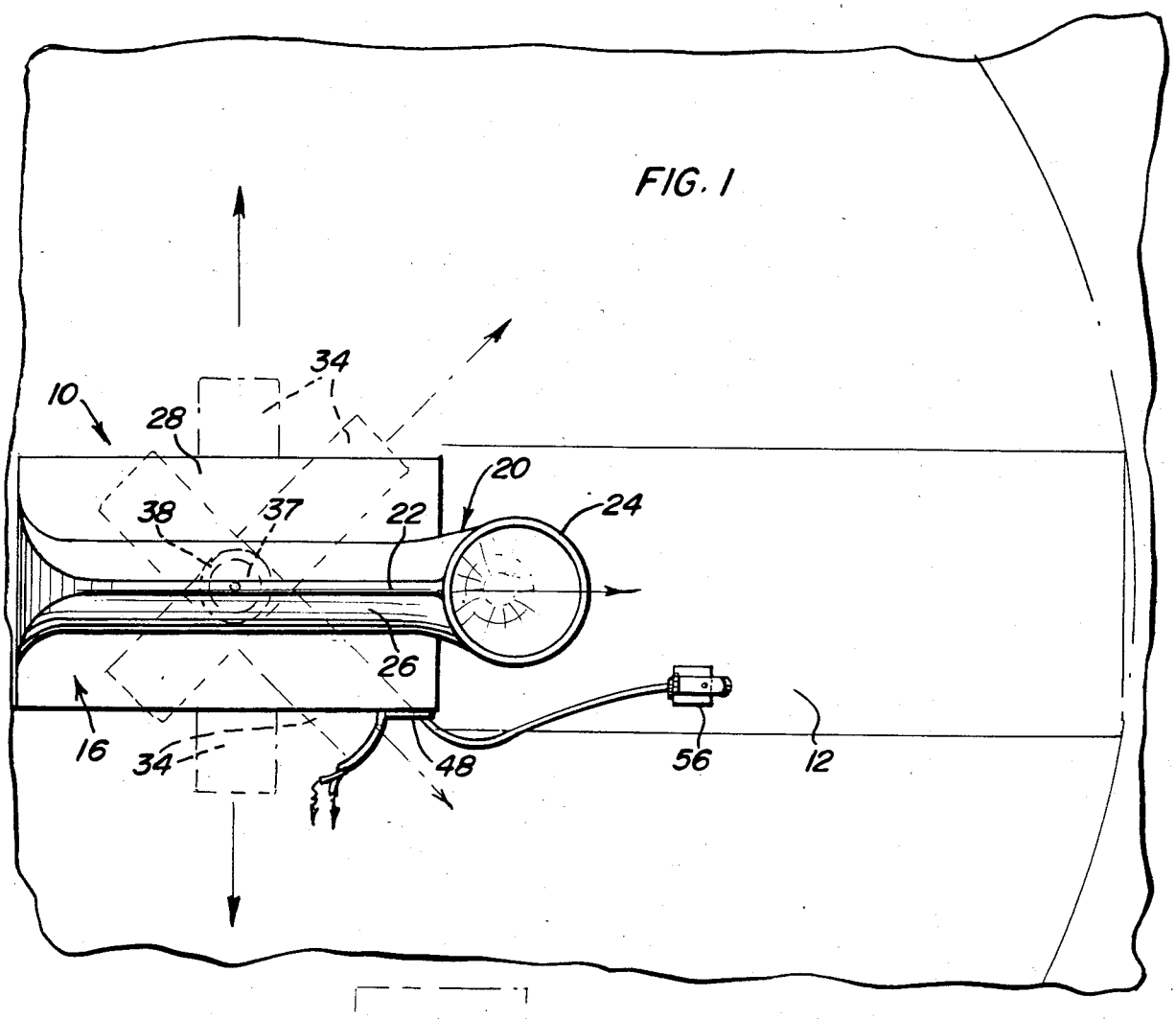
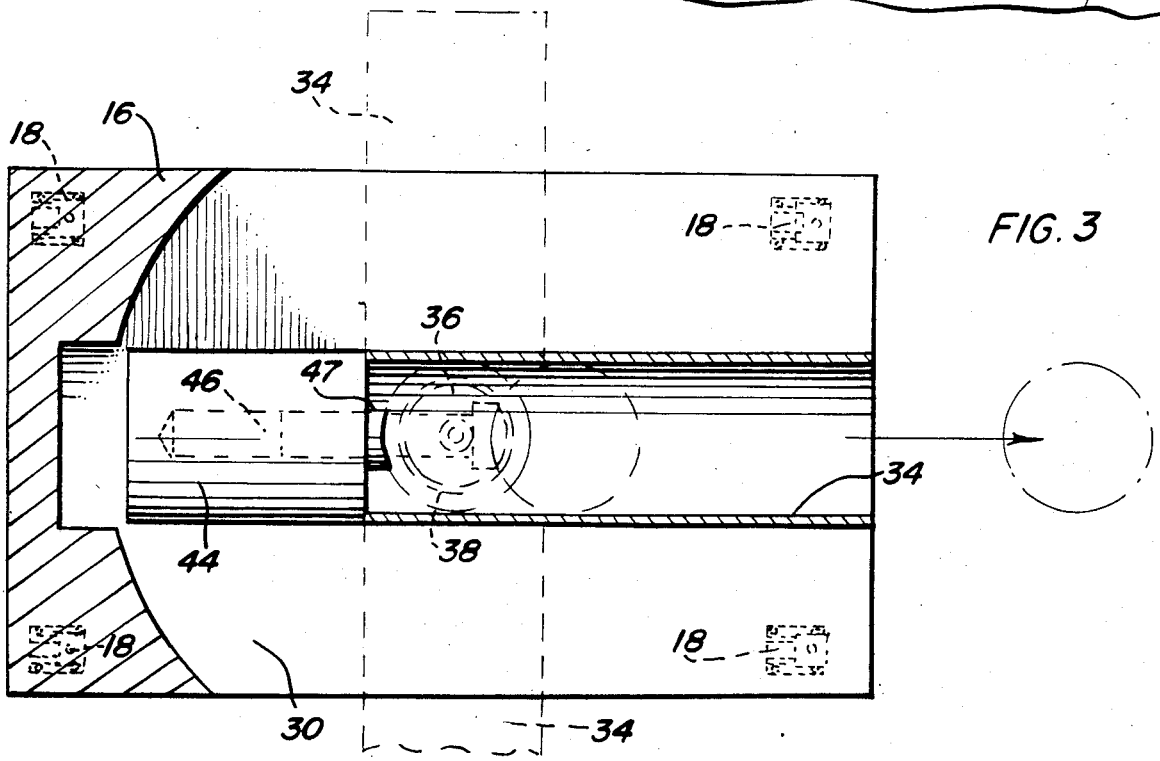
FIG. 3

BASKETBALL RETURN DEVICE

BACKGROUND OF THE INVENTION

This invention relates to a device for use in practicing basketball shots, so as to relieve a player or players of the task of manually retrieving balls from under or around a basketball basket and returning same to the player or players on a court, thereby making more efficient use of available practice time. Accordingly, the invention provides a device for collecting balls which are shot toward a basketball net, and for mechanically returning the balls to a selected on-court location.

STATEMENT OF PRIOR ART

Applicants are aware of the following U.S. patents, the relevance of which is that they relate to basketball return devices and other ball-propelling mechanisms. None of the patents, however, discloses a device having the features of the present invention.

U.S. Pat. No. 2,805,070
U.S. Pat. No. 3,194,556
U.S. Pat. No. 3,233,896
U.S. Pat. No. 3,549,148
U.S. Pat. No. 3,776,550
U.S. Pat. No. 3,917,263

SUMMARY OF THE INVENTION

A basketball return device in accordance with the invention comprises a portable unit for positioning on a basketball court or the like in a location generally underneath a basket into which shooting practice is to be conducted, the device including a box-like base, conveniently on wheels or casters, the base including a ball-return mechanism, and a vertically extending chute projecting upwardly from the base and terminating in a hoop-like top opening for positioning substantially directly beneath the basket. The hoop-like top opening may be oversize with respect to the basket so as to collect balls which are successfully shot through the basket and also to collect near misses. The ball-return mechanism may include a horizontal ball-collection and dispersion tube mounted in a slot in the base for swinging movement in a horizontal plane about a vertical axis under the control of an electric motor or like drive having a drive shaft defining said axis, the tube having an upper ball-receiving opening concentric with said axis for receiving balls from the chute, and a ball-expelling plunger behind the opening which may be solenoid-operated, for projecting balls through the tube to a position on the court dependent on the angular position of the tube, the device further including control means for angularly positioning the tube and for controlling operation of the plunger.

A ball-return mechanism in accordance with the invention comprising the swinging tube with ball-expelling plunger can be adapted to diverse forms of automatic or semi-automatic control. Accordingly, electrical control means may be provided for the mechanism for automatically swinging the tube through a series of angular positions and returning balls sequentially to the respective positions. Additionally or alternatively, a semi-automatic control may be provided including a foot pedal or like player-activated control for returning balls to a set position under the player's control with the tube drive being deactivated so that the tube remains in fixed position. Combinations of the above and other control sequences may also be provided within the scope of the invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWINGS

FIG. 1 is a plan view of a basketball return device in accordance with the invention.

FIG. 3 is a sectional view on line 3—3 of FIG. 2.

DESCRIPTION OF PREFERRED EMBODIMENT

Figure 2:
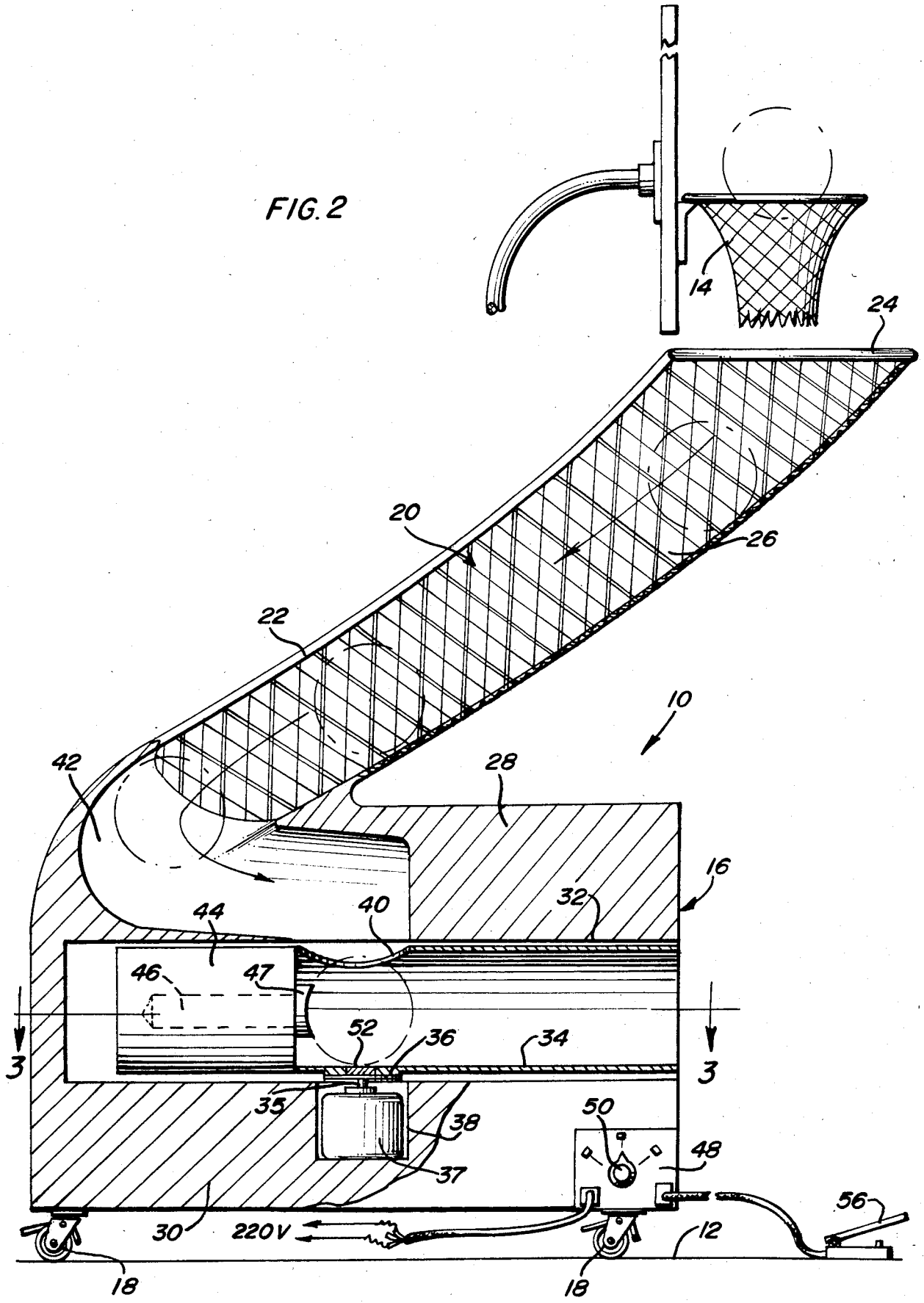
FIG. 2 is an enlarged sectional elevational view of the device.

The drawings show a portable basketball device 10 in accordance with the invention positioned on a basketball court 12 under a basket 14 at one end of the court for the purpose of returning balls to a player or players on the court during shooting practice so as to relieve the player or players of the task of retrieving the balls.

Device 10 comprises a box-like base 16 on lockable casters 18, the base including a ball-return mechanism as will be described in greater detail below, and a chute structure, generally designated 20, for receiving balls shot toward the basket and delivering them to the ball-return mechanism.

The chute structure may, for example, include a support rib or spine 22 extending in upwardly inclined relation from the top of base 16, a hoop 24 at the top of the rib defining an upper opening of the chute located directly under basket 14, and netting 26 or the like suitably secured to the hoop and rib to form an enclosed tubular body for the chute. Hoop 24 may be considerably oversize in relation to basket 14 (due to space restrictions, the hoop is not shown to scale in the drawings) so as to collect shots which are successfully made and also shots which miss the basket. Further, the illustrated chute structure is shown by way of example only and is not critical to the invention. Any suitable chute arrangement for receiving balls from below basket 14 and delivering them to the ball-return mechanism can be used.

Base 16 of the device may be of any suitable construction, for example it may be formed from molded plastic sections, including an upper section 28 and a lower section 30 defining a horizontal slot 32 therebetween for a tube 34 of the ball-return mechanism, the slot being open at the front and sides of the base. Tube 34 is supported on a disk 36 carried on the output shaft 35 of an electric motor 37 received in a well 38 formed in the lower section 30 of the base (a speed reducing means may be interposed between the motor and the disk) so that operation of the motor causes the tube to swing in slot 32 about a vertical axis defined by shaft 35. Tube 34 has a ball receiving opening 40 above and concentric with shaft 35, opening 40 being in communication with a throat 42 formed in upper section 28 of the base for delivering balls from the base portion of chute structure 20 into tube 34. The rearward end of tube 34 carries a solenoid 44 with an axial plunger 46 for expelling a ball through the forward end of the tube. The head 47 of the plunger in the retracted position is immediately back of opening 40 so as to be in position to expel a ball received through the opening when thrust forwardly by operation of the solenoid. The tube may be provided with suitable means for retaining a ball directly under opening 40 until expelled by the plunger. For example, the tube may be formed with a slight depression under the opening, or it may be tilted slightly upwardly toward its forward end.

It will be understood from the foregoing that the structural configuration of the device allows basketballs to be received in tube 34 and expelled therefrom in any rotational position of the tube, whereby the balls may be returned to different locations on the basketball court. For example, when the tube faces straight ahead, balls can be returned to the region of the free throw line, when the tube is rotated through 90° in either direction, balls can be returned toward opposite corners of the base line, and when the tube is rotated through 45°, balls can be returned to locations between the free throw line and the base line.

The structure of the invention lends itself to diverse forms of electrical control for positioning tube 34 and for operating the plugner 46. Further, the device may include a plurality of selectable control modes operated from a control panel 48 on base 16 through a selector switch 50. Such controls may, for example, include automatic, manual and movable control modes, selected according to the positioning of switch 50 and functioning as described below.

In the automatic mode, for example, the device may be controlled to return successive balls to different locations on the court automatically, by rotation of tube 34 through a preselected angle responsive to a ball being received through opening 40. To this end, a weight-responsive electric sensor 52 may be provided in the tube under opening 40 which, when actuated by a ball entering the tube, causes the motor 37 to step the tube through a required angle, through a timer or suitable limit switches. Upon attaining the new position of the tube, the timer may then actuate solenoid 44 to operate plunger 46 through suitable relay means and after a suitable time delay. When the next ball is received the process is repeated with the tube being moved to its next angular position. The tube may be moved in this manner through a series of 45° increments, and then back again, so as to allow a player to move through a series of shooting positions on the court automatically receiving a ball in each position.

For the manual mode of operation, a plug-in-foot pedal control 56 may be provided for on-court operation by a player. In this mode, motor 37 may be disconnected and tube 34 may be manually set to a position for returning balls to a required location on the court. Actuation of the foot pedal effects operation of the solenoid and plunger, allowing the player to control the return of balls and practice a specific shot at the player's own pace.

In the movable mode, for example, the tube may be manually set in fixed position and the balls returned to the preset location automatically by connection in circuit of the aforementioned sensor and timer, with the motor being disconnected. This mode of operation therefore returns the balls to the player at a set timing and in a fixed position on the court.

It will be understood that modifications and/or combinations of the desired operating modes can be incorporated in the structure of the invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A basketball return device comprising a portable unit for positioning on a basketball court or the like in a location generally underneath a basket into which shooting practice is to be conducted, the device having a base including a ball-return mechanism, and a vertically extending chute projecting upwardly from the base and terminating in a hoop-like top opening for positioning substantially directly beneath the basket, wherein the ball-return mechanism includes a horizontal ball-collection and dispersion tube mounted in the base for swinging movement about a substantially vertical axis for directing balls through an open forward end of the tube to a required on-court location dependent on the angular position of the tube about said axis, the tube having a power-operated plunger means at a rearward end thereof for expelling balls through the forward end, and the tube further including an upper opening concentric with said axis for receiving balls from the chute.

2. The invention of claim 1 including electric drive means in the base for moving the tube about said axis, the drive means having an output shaft defining said axis and mounting means supporting the tube on a free end of the shaft.

3. The invention of claim 2 wherein the drive means comprises an electric motor mounted below the tube with the output shaft extending upwardly from the motor and the mounting means comprising a tube-carrying member at the upper end of the shaft.

4. The invention of claim 2 wherein the power-operated plunger means comprises a solenoid-operated plunger and the device includes control means for operating the motor to locate the tube in a required angular position, and further control means for operating the plunger.

5. The invention of claim 2 wherein the base comprises a box-like member on casters and the tube is mounted in a horizontal slot in the base.

6. The invention of claim 1 wherein the chute includes an inclined rib member extending upwardly from the base, a hoop member at the upper end of the rib member defining the top opening, and an enclosed chute body of netting material supported from the hoop and rib members.

7. The invention of claim 6 wherein the base includes an inclined throat portion connecting the lower end of the chute with said opening in the tube.

* * * * *